US007853168B2

(12) United States Patent
Shimada

(10) Patent No.: US 7,853,168 B2
(45) Date of Patent: Dec. 14, 2010

(54) PRINTING APPARATUS AND PRINTING METHOD

(75) Inventor: Bungo Shimada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 178 days.

(21) Appl. No.: 12/335,406

(22) Filed: Dec. 15, 2008

(65) Prior Publication Data

US 2009/0162090 A1 Jun. 25, 2009

(30) Foreign Application Priority Data

Dec. 20, 2007 (JP) ..... 2007-328729

(51) Int. Cl.
*G03G 15/00* (2006.01)

(52) U.S. Cl. ..... 399/82

(58) Field of Classification Search ..... 399/38, 399/77, 82, 83, 382, 388, 405
See application file for complete search history.

(56) References Cited

U.S. PATENT DOCUMENTS

| | | | | |
|---|---|---|---|---|
| 6,148,164 | A * | 11/2000 | Shima | 399/82 |
| 7,009,719 | B2 * | 3/2006 | Willis et al. | 358/1.1 |
| 7,302,199 | B2 * | 11/2007 | German et al. | 399/82 |
| 7,386,246 | B2 * | 6/2008 | Yabe | 399/82 |
| 7,649,645 | B2 * | 1/2010 | Frankel | 358/1.16 |
| 2002/0136564 | A1 * | 9/2002 | Takamine et al. | 399/82 |
| 2003/0103777 | A1 * | 6/2003 | Nakamura et al. | 399/82 |
| 2004/0170443 | A1 * | 9/2004 | Maeshima | 399/82 |
| 2006/0290730 | A1 | 12/2006 | Teshigawara et al. | |
| 2007/0146789 | A1 | 6/2007 | Mima et al. | |

FOREIGN PATENT DOCUMENTS

| | | | |
|---|---|---|---|
| JP | 2001-042635 | A | 2/2001 |
| KR | 10-2006-0134836 | A | 12/2006 |
| KR | 10-2007-0068277 | A | 6/2007 |

* cited by examiner

*Primary Examiner*—David P Porta
*Assistant Examiner*—Kiho Kim
(74) *Attorney, Agent, or Firm*—Canon USA Inc IP Division

(57) ABSTRACT

A printing apparatus includes a receiving means for receiving a printing job including a plurality pages, a printing means for performing printing processing on a plurality of papers based on the received printing job, a paper discharge means for discharging the plurality of papers which has been subjected to the printing processing, storing means for storing job information for specifying the printing job and paper-discharge-interval control information for controlling a paper discharge interval, a determination means for, when the printing processing based on the received printing job is performed, determining whether there exists a performed printing job that is substantially the same as the received printing job based on the job information stored in the storing means, and a control means for, when the determination means determines that the performed printing job exists, controlling the paper discharge interval based on the paper-discharge-interval control information.

9 Claims, 11 Drawing Sheets

FIG.3

JOB MANAGEMENT TABLE

| JOB ID | JOB NAME | JOB OWNER NAME | HOST NAME | CONDITION OF DISCHARGING PAPER | THE NUMBER OF PAGES | PDL-DATA HASH VALUE |
|---|---|---|---|---|---|---|
| 1 | ESTIMATE.doc | USER A | PC123 | STAPLE | 10 | 0x5f578934 |
| 2 | ESTIMATE.doc | USER A | PC123 | STAPLE | 10 | 0x5f578934 |
| 3 | SCHEDULE.xls | USER B | WS001 | NONSORT | 5 | 0x45896657 |
| 4 | ESTIMATE.doc | USER A | PC123 | STAPLE | 10 | 0x5f578934 |
| 5 | SPECIFICATION | USER C | VX105 | STAPLE | 5 | 0xfdef5361 |
| 6 | BUSINESS TRIP REPORT | USER D | PC224 | SORT | 3 | 0x4563edac |

FIG.4

APPLIED-TONER AMOUNT TABLE

| JOB ID | PAGE 1 | PAGE 2 | PAGE 3 | PAGE 4 | PAGE 5 | PAGE 6 | PAGE 7 | PAGE 8 | PAGE 9 | PAGE 10 |
|---|---|---|---|---|---|---|---|---|---|---|
| 1 | 20% | 200% | 100% | 130% | 40% | 55% | 65% | 170% | 130% | 10% |
| 3 | 10% | 15% | 10% | 13% | 20% | | | | | |
| 5 | 20% | 30% | 40% | 20% | 10% | | | | | |
| 6 | 100% | 150% | 200% | | | | | | | |

FIG.5

FEEDING-PAPER-INTERVAL CONTROL TABLE

| TONER AMOUNT / PAPER TYPE | 0-50% | 51-100% | 101-150% | 151-200% | 200%- |
|---|---|---|---|---|---|
| PLAIN PAPER | 0 [sec] | 0.5 [sec] | 2.0 [sec] | 4.0 [sec] | 10.0 [sec] |
| THICK PAPER | 0.1 [sec] | 1.0 [sec] | 4.0 [sec] | 8.0 [sec] | 20.0 [sec] |

PRINTING APPARATUS AND PRINTING METHOD

BACKGROUND OF THE INVENTION

1. Field of the Invention

The present invention relates to a printing apparatus and a printing method.

2. Description of the Related Art

In recent years, the performance of printers has been greatly enhanced, which tends to cause the temperature within a device to rise. As a result, it sometimes happens that discharged papers adhere to each other due to toner on the papers. In order to prevent the discharged papers from adhering, Japanese Patent Application Laid-Open No. 2001-42635 discusses a method for controlling a rotation speed of a development sleeve according to the temperature around a development apparatus. However, according to the method, a temperature sensor needs to be provided in the apparatus, which raises apparatus cost.

Under such circumstances, a technology has been developed for controlling a paper feed interval according to an applied-toner amount to prevent the discharged paper from adhering to each other. The applied-toner amount indicates an amount of toner applied on the paper. According to the technology, the applied-toner amount is detected by measuring video signals included in image data when printing. The video signals are measured to detect whether each pixel forming an image is to be exposed.

Since the number of pixels to be exposed when printing the image data, can be obtained by measuring the video signals, the amount of toner necessary for printing, that is, the applied-toner amount can be found. However, in this case, if the paper feed interval is controlled only after the applied-toner amount is obtained, the printing interval becomes too long.

Therefore, when performing a printing job for a plurality of copies, the applied-toner amount for each page is recorded when outputting the first copy. As to the second or later copy, the applied-toner amount recorded for the first copy is used to control the paper feed interval between pages. However, the above-described technology could not be used in certain inexpensive printers, since the certain inexpensive printers operating as a stand-alone apparatus could not recognize the plurality of copies.

On the other hand, an average printer includes a memory medium having a large capacity therein to store a whole image data for a plurality of pages. Accordingly, when performing the printing job for the plurality of copies, the image data of a first copy is stored in the memory medium, and the printing of a second or later copy is performed using the stored image data. Since the certain inexpensive printers do not have the memory medium having a large capacity, the inexpensive printers cannot store the whole image data for the plurality of pages.

When printing the image data for the plurality of pages, the certain inexpensive printers divide the plurality of pages into units of several pages, sequentially stores the image data for the several pages in the memory medium, performs printing, and deletes the image data. These operations are repeated by the inexpensive printers. Accordingly, in a case where the certain inexpensive printer perform the job for printing the plurality of copies, a host side such as a personal computer (PC) generates the number of image data corresponding to the number of the copies. The printers receive the image data from the host side, and print each copy.

More specifically, the certain inexpensive printers can regard the printing of the plurality of copies only as printing one copy a plurality of times. Even if there is a plurality of jobs that can be regarded as the same, those jobs are processed as the independent printing job that has no relations with each other. Therefore, when printing the plurality of copies, the printer could not control the paper feed interval by using the applied-toner amount recorded for the first copy as described above.

SUMMARY OF THE INVENTION

The present invention is directed to a printing apparatus capable of preventing a plurality of papers from adhering to each other, by discharging the plurality of papers to a paper discharge section at an appropriate interval.

According to an aspect of the present invention, a printing apparatus includes a receiving unit configured to receive a printing job including a plurality of pages of image data, a printing unit configured to perform printing processing on a plurality of substrates based on the printing job received by the receiving unit, a substrate discharge unit configured to discharge the plurality of substrates which has been subjected to the printing processing by the printing unit, a storage unit configured to store job information for specifying the printing job and substrate-discharge time-interval control information for controlling a substrate discharge time-interval at which the substrate discharge unit discharges the plurality of substrates to the substrate discharge section, a determination unit configured to, when the printing processing is performed based on the received printing job, determine whether there exists an already performed printing job that is substantially the same as the received printing job based on the job information stored in the storage unit, and a control unit configured to, when the determination units determines that the already performed printing job exists, control the substrate discharge time-interval based on the substrate-discharge time-interval control information corresponding to the performed printing job.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 3 illustrates a job management table stored in a job-information storage unit according to the exemplary embodiment of the present invention.

FIG. 4 illustrates an applied-toner amount table stored in a job-information storage unit according to the exemplary embodiment of the present invention.

FIG. 5 illustrates a paper-feed-interval control table stored in a read only memory (ROM) in an image processing unit according to the exemplary embodiment of the present invention.

DETAILED DESCRIPTION OF THE EMBODIMENTS

Various exemplary embodiments, features, and aspects of the invention will now be described in detail with reference to the drawings. In the embodiments, the meaning of "sheet" includes the meaning of "paper".

Figure 1:
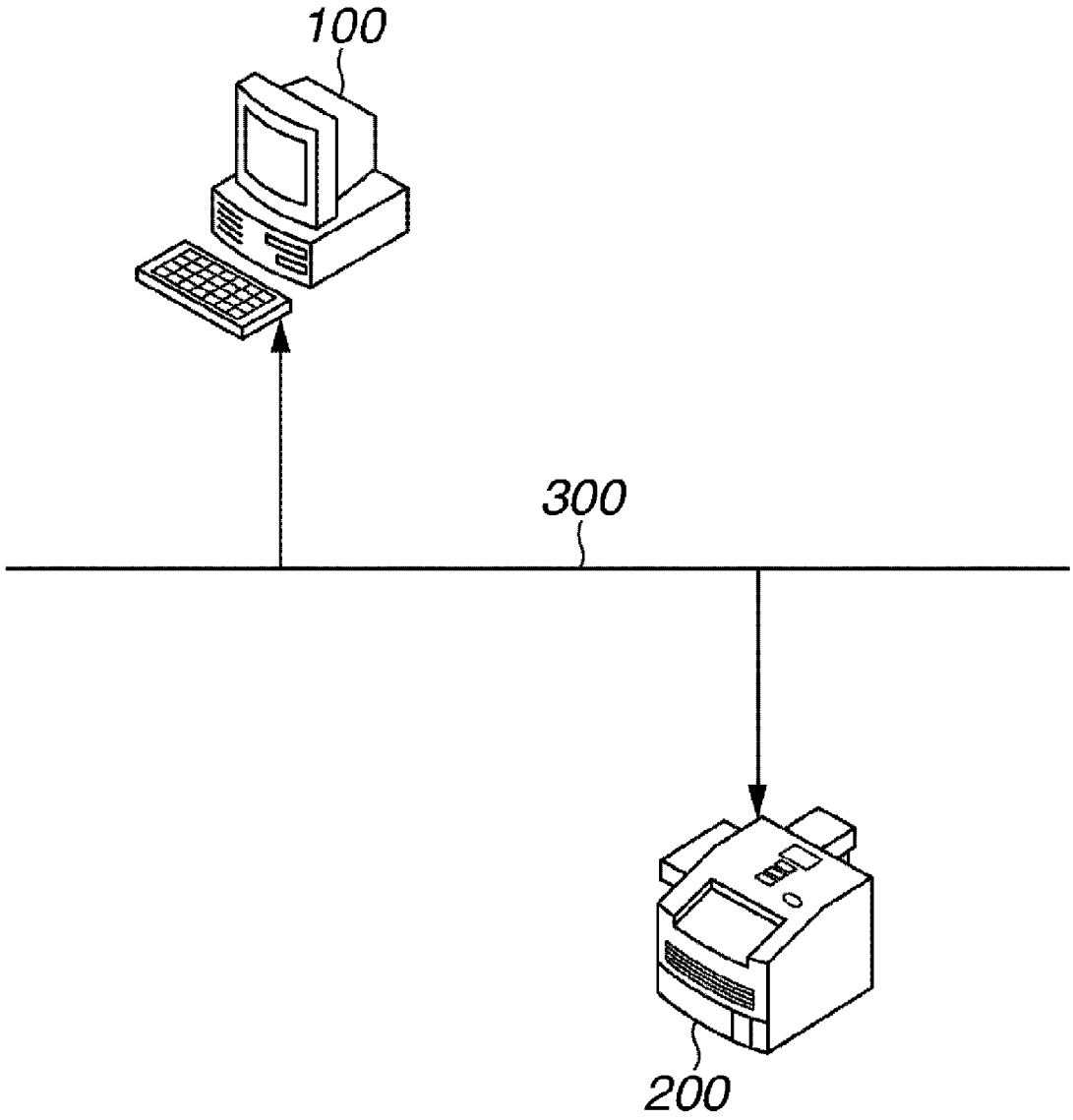
FIG. 1 is a diagram illustrating a system of an exemplary embodiment of the present invention.

FIG. 1 is a diagram of a system according to a first exemplary embodiment of the present invention. A PC 100 serves as an information processing apparatus. A printer 200 serves as a printing apparatus. A network 300 connects the PC 100 and the printer 200, and transmits data such as a printing job. The PC 100 and the printer 200 may be locally connected as well as connected via the network.

Figure 2:
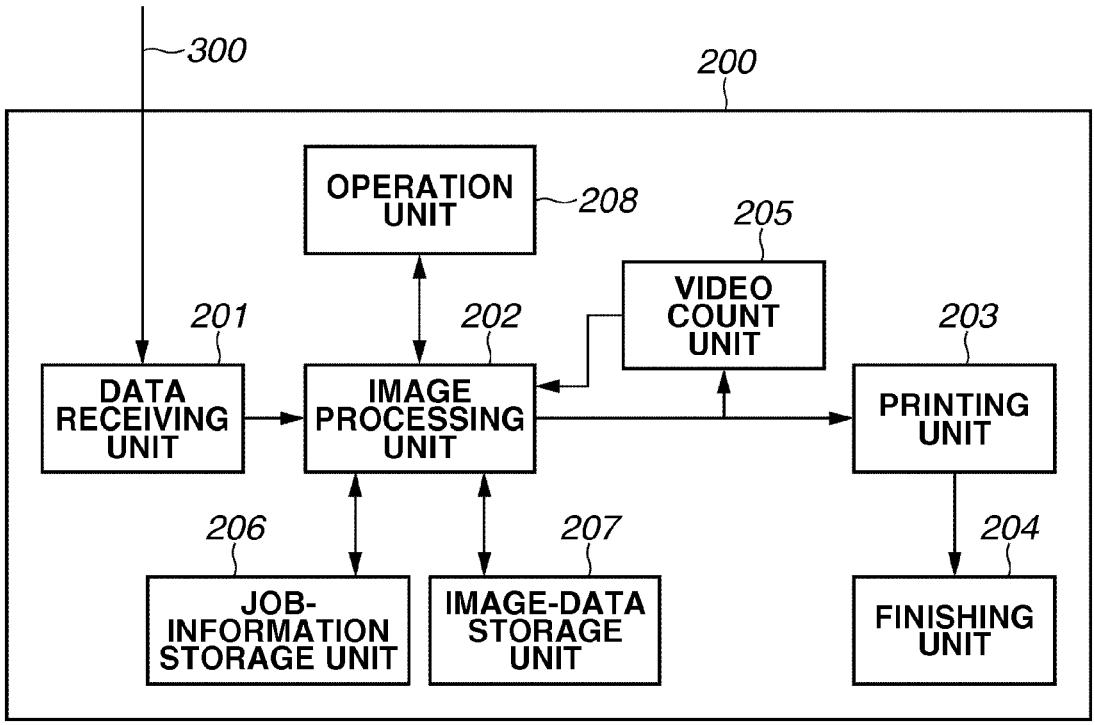
FIG. 2 is a functional bloc diagram illustrating a printer according to the exemplary embodiment of the present invention.

FIG. 2 is a functional bloc diagram illustrating the printer 200 according to the first embodiment. Each block illustrates a module, and arrows between the blocks illustrate flows of the data. A data receiving unit 201 receives a printing job input from the PC 100 via the network 300. An image processing unit 202 includes a central processing unit (CPU) and a memory medium such as the ROM, or a random access memory (RAM) The image processing unit 202 interprets the printing job received by the data receiving unit 201, and performs processing on the image data included in the printing job.

The CPU reads out to the RAM a program stored in the ROM (which will be described below using FIGS. 6 and 7) and performs the program to control an operation of each unit. A printing unit 203 prints the image data processed by the image processing unit 202. A finishing unit 204 performs finishing processing using a staple or the like on the paper printed by the printing unit 203. A video count unit 205 counts page by page the number of pixels forming an image, from video signals which are transmitted from the image processing unit 202 to the printing unit 203, and notifies the results to the image processing unit 202.

By measuring the video signals, the applied-toner amount that is applied on the paper of each page can be detected. An information storage unit 206 follows an instruction from the image processing unit 202 and temporarily stores the information about the printing job. A storage unit 207 follows an instruction from the image processing unit 202 and temporarily stores the image data of the printing job. An operation unit 208 notifies information to a user and inputs an instruction from the user.

FIG. 3 illustrates a job management table according to the first exemplary embodiment. This table is stored in the job-information storage unit 206. In step S103 (which will be described below using FIG. 6), the information is added to this job management table. In step S201 (which will be described below using FIG. 7), it is determined according to the information in the job management table whether a job that can be regarded as substantially the same as a print target job has been previously input. The job information is set to each input job.

A Job identification data (ID) differentiates the job information. A job name is a named given to the job. A job owner name is a name of an owner who created the job. A host name is a name of a host computer which transmitted the job. A condition of discharging paper is a condition of processing to be performed after the job is printed. A number of pages are the number of pages of images that the job is to print. A PDL data hash value is a hash value of information about a printing image in the job data.

The Job ID is created by the job processing unit 202. The job name, job owner name, host name, condition of discharging paper, the number of pages, and PDL data hash value are extracted from the input job by the job processing unit 202. FIG. 4 is a diagram illustrating an applied-toner amount table according to the first exemplary embodiment. This table is stored in the job-information storage unit 206. In step S213 (which will be described below using FIG. 7), the applied-toner amount is added to the applied-toner amount table. In step S207 (which will be described using FIG. 7), a paper discharge interval between output papers is controlled according to the applied-toner amount in the applied-toner amount table.

A record of the table is added for each job, and the applied-toner amount is recorded for each page in each record as information for controlling the paper discharge interval. The more the applied-toner amount is, the longer time it takes to dry the toner, which makes it likely that the papers adhere to each other. The applied-toner amount is detected for each page by a following procedure. First, a video count unit 125 measures video signals.

Sequentially, from the measured video signals, the image processing unit 202 analyzes whether each pixel forming an image is to be printed (exposed). The number of pixels that are to be printed (exposed) is divided by the number of all pixels to detect the applied-toner amount in percent (ratio). For example, the video count signals including 432,000 pixels for one page are measured, and it is determined that 216,000 pixels are to be printed (exposed). In that case, 50 percent is determined to be the applied-toner amount For black and white print, the applied-toner amount is maximum 100 percent. For color print (four colors are cyan, magenta, yellow, black (CMYK)), the applied-toner amount is maximum 100 percent for each color, and thus maximum 400 percent for all. For example, when only a K toner is applied on a surface of paper, the applied-toner amount is 100 percent. When 50 percent of each of CMYK toner is applied, the applied-toner amount is 200 percent.

Further, according to the present exemplary embodiment, the applied-toner amount is detected in percent. However, a numeral value other than percent, for example, the number of pixels that are to be printed (exposed) may be detected as the applied-toner amount. FIG. 5 illustrates a paper-feed-time-interval control table according to the first exemplary embodiment. This table is stored in the ROM in the image processing unit 202. In step S207 (which will be described below using FIG. 7), the paper feed time interval is controlled according to information in the paper-feed time-interval control table. The paper feed time-interval is set depending on a paper type such as plain paper and thick paper, that is, according to the applied-toner amount.

Figure 6:
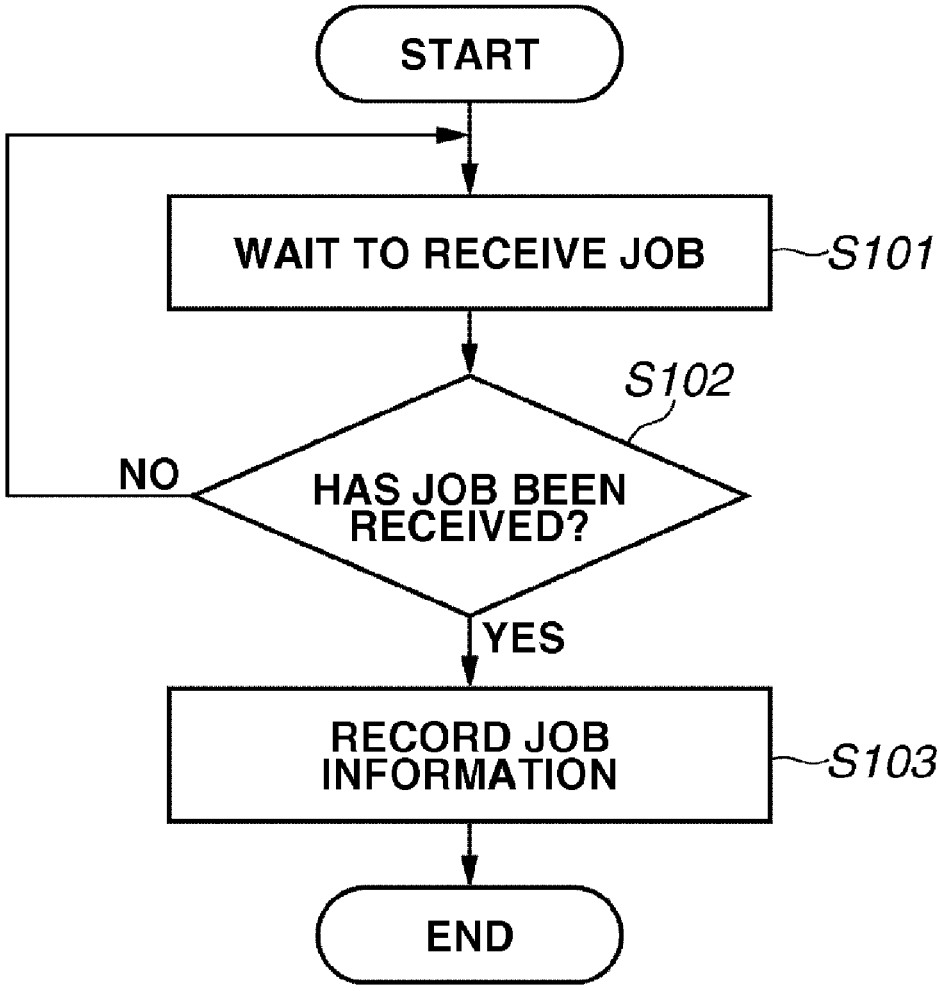
FIG. 6 is a flowchart illustrating processing for receiving a printing job in the printer according to the exemplary embodiment of the present invention.

In other words, under a condition where it takes longer to dry out the toner, the paper feed time-interval is set to be longer in order to ensure the time for drying out the toner and to prevent the output papers from adhering to each other. FIG. 6 is a flowchart illustrating processing for receiving a printing job in a printer 200 according to the first exemplary embodiment of the present invention. In this processing, the CPU reads out and performs a program stored in the ROM in the image processing unit 202.

First, in step S101, the image processing unit 202 waits for the data receiving unit 201 to receive a job. Next, in step S102, the image processing unit 202 determines whether the data receiving unit 201 receives the job in step S101. When the image processing unit 202 determines that the image processing unit 202 has received the job, the processing proceeds to step S103. When the image processing unit 202 determines that the image processing unit 202 has not received the job, the processing returns to step S101.

The image processing unit 202 analyses the job received in step S101, and stores the image data in the image-data storage unit 207. Further, the image processing unit 202 records the job information illustrated in FIG. 3 in the job management table in the job-information storage unit 206. In step S103, if the job management table does not exist in the job-information storage unit 206, the image processing unit 202 creates the job management table and records the job information in the job management table. The job management table does not exist in the job-information storage unit 206 in a case where, for example, the received job has been a first job input after the printer 200 is started up or after the printer 200 is initialized. In step S103, the receiving processing is completed, and the printing processing illustrated in FIG. 7 follows.

Figure 7:
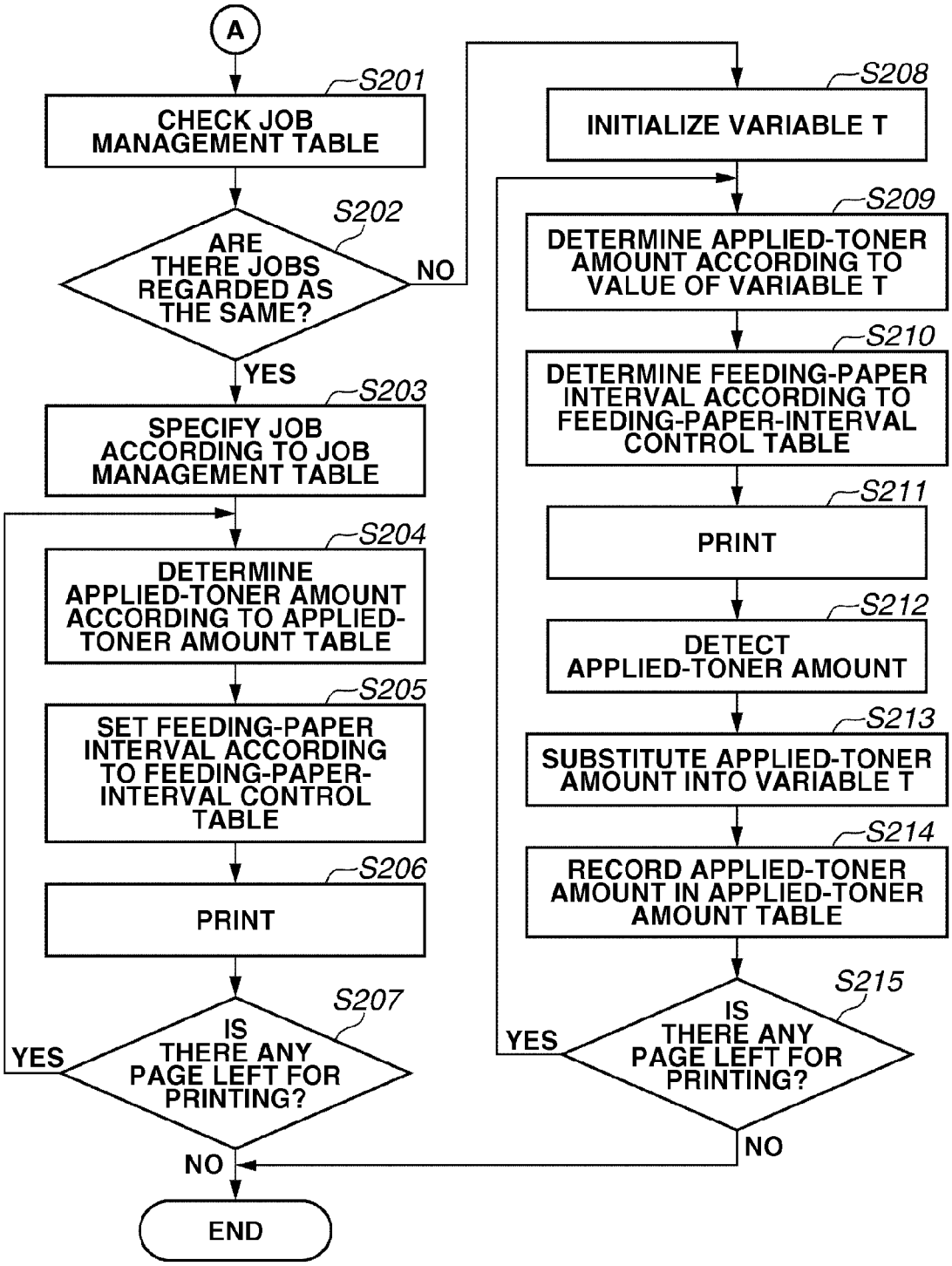
FIG. 7 is a flowchart illustrating printing processing of the printing job in the printer according to the exemplary embodiment of the present invention.

FIG. 7 is a flowchart illustrating printing processing of a printing job in the printer 200 according to the exemplary embodiment of the present invention. In the processing, the CPU reads out and performs the program recorded in the ROM in the image processing unit 202. In the printing processing, printing of a plurality of papers (substrates) is carried out.

In step S201, first, the image processing unit 202 checks the job management table stored in the job-information storage unit 206. In step S202, the image processing unit 202 determines whether there exists among the already performed printing jobs a job that can be regarded as substantially the same job as the printing job that is being performed. This determination is made based on the values such as the job name, job owner name, host name, condition of discharging paper, the number of pages, and PDL data hash value. The number and types of the values that are bases for making the determination can be changed arbitrarily. For example, in FIG. 3, when a setting is defined such that the jobs having the same job name as a host name are regarded as substantially the same job, the Job ID1, Job ID2, Job ID4 can be regarded as the substantially same job.

In this case, the Job ID1 corresponds to a first copy, the Job ID2 corresponds to a second copy, and the Job ID4 corresponds to a third copy. Since the processing for determining the jobs as the same job by using the job management table has not been conventionally performed, the Job ID1, Job ID2, and Job ID4 have not been regarded as substantially the same job. In step S201, when it is determined that there exists a job that can be regarded as substantially the same job as the printing job that is being performed among the already performed printing jobs, the process proceeds to step S203. When it is determined that no such job exists, the processing proceeds to step S208.

In step S202, when it is determined that there exists a job among the already performed printing jobs that can be regarded as substantially the same job as the printing job that is being performed, the printing job is performed for the second or later copy among the plurality of printing copies. In this case, the paper discharge time-interval for the printing job is controlled based on the applied-toner amount of the job corresponding to the first copy of the plurality of printing copies.

First, in step S203, the image processing unit 202 specifies a job having a smallest Job ID among the jobs regarded as the same job in step S201 as a job corresponding to the first copy of the plurality of printing copies by using the job management table. Next, in step S204, the image processing unit 202 determines the applied-toner amount corresponding to the page immediately preceding the page to be printed, from the job specified in step S203 by using the applied-toner amount table.

In step S204, the applied-toner amount for the page corresponding to the page to be printed may also be determined as the applied-toner amount. Further, between the two of the applied-toner amounts corresponding to the immediately preceding page and the page to be printed, the larger one may also be determined to be the applied-toner amount.

Next, in step S205, the image processing unit 202 sets the paper feed time interval (or conveyance speed of the paper) based on the applied-toner amount determined in step S204 and a paper type to be printed, by using the paper-feed-interval table. In step S206, the image processing unit 202 prints the pages with the printing unit 203 based on the paper feed time interval set in step S205.

In this case, the paper can be fed for the following page while the previous page is being printed. As a result, timing for discharging the printed paper can be controlled for each paper. If more time than the paper feed interval set in step S205 has lapsed since the previous page was fed, the paper feed interval is not controlled.

Next, in step S207, the image processing unit 202 determines whether there is any page left for printing. This determination is made by checking whether image data for the following page is left in the image data storage unit 207. When it is determined that there is a page left to be printed in step S207, the processing returns to step S204, and the image processing unit 202 performs the printing on the following page with the printing unit 203. When it is determined that there is no page left for printing in step S207, the processing is ended.

Figure 8:
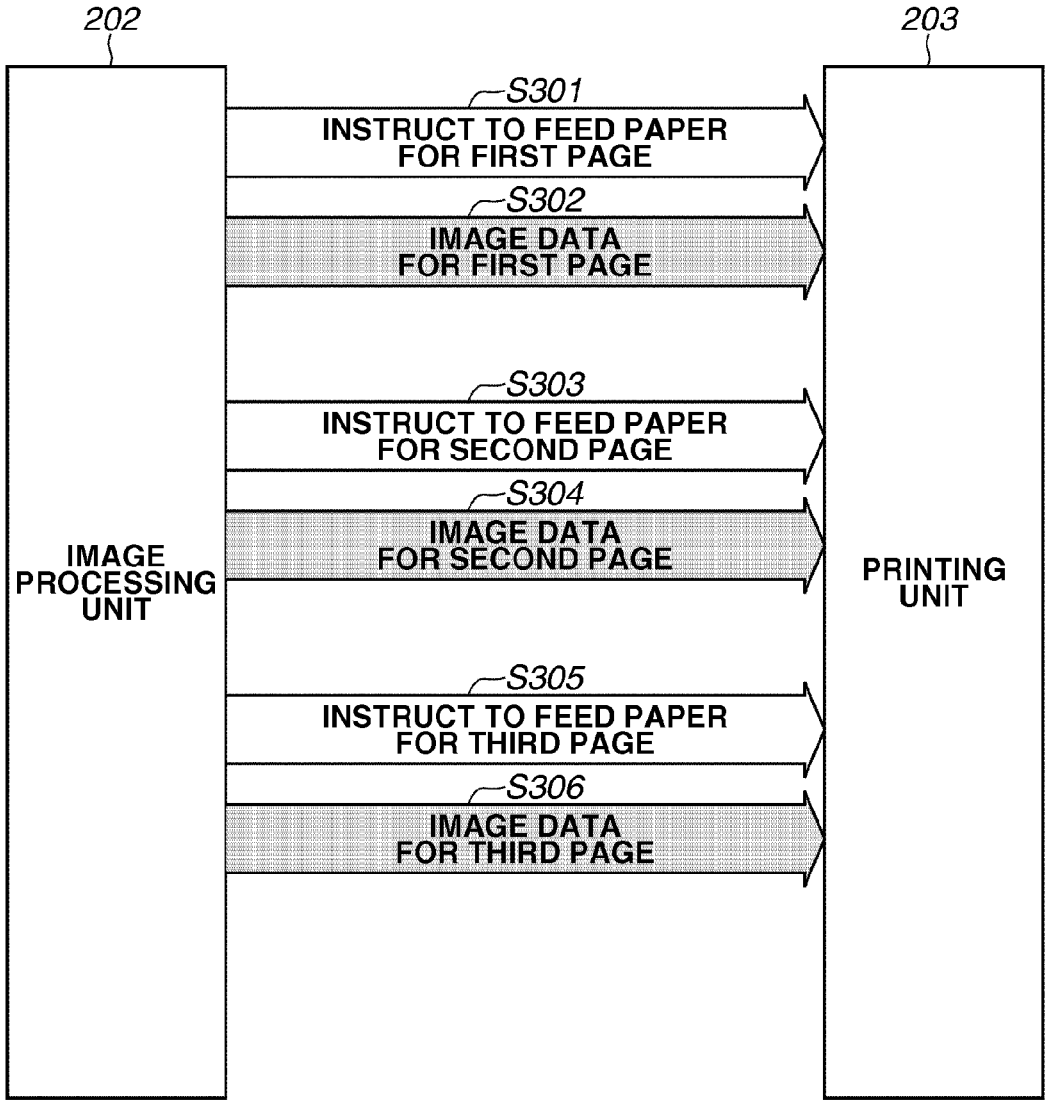
FIG. 8 is a diagram illustrating in a time series fashion the communication of signals between the image processing unit and a printing unit when loop processing from steps S204 to S207 is performed as illustrated in FIG. 7.

FIG. 8 is a diagram illustrating in a time series fashion the communication of signals between the image processing unit 202 and the printing unit 203 when loop processing from steps S204 to S207 is performed. Steps S301 to S302 illustrate for the first page, steps S303 to S304 illustrate for the second page, and steps S305 to S306 illustrate for the third page the communication of the signals when the loop processing from S204 to S207 is performed.

As described above, in the second or later copy, since the paper feed interval (or conveyance speed of the paper) is controlled using the applied-toner amount for the previous job, the printing time can be decreased. In step S201, if it is determined that there exists no job that can be regarded as substantially the same as the printing job that is being performed, among the already performed printing jobs, the printing job is a job for the first copy among the plurality of printing copies.

In this case, the paper discharge interval for the printing job is controlled based on the applied-toner amount of the job detected by the video counter. First, in step S208, the image processing unit 202 initializes a variable "T" storing the applied-toner amount for the printed page. In initializing the variable "T", the variable "T" is created and an initial value "0" is stored as the variable "T".

Next, in step S209, the image processing unit 202 determines the applied-toner amount from a value of the variable "T". When the page to be printed is the first page, the value of the variable "T" is "0" that has been stored in step S208. When the page to be printed is the second or later page, the value of the variable "T" is the value substituted in step S213.

In step S210, the image processing unit 202 sets the paper feed time interval (or conveyance speed of the paper) between the pages to be printed, based on the applied-toner amount determined in step S209 and the paper type, by using the paper-feed-interval table. In step in S211, the image processing unit 202 prints the pages with the printing unit 203 based on the paper feed interval set in step S210.

In this case, since the paper for the following page begins to be fed after the applied-toner amount for the previous page is notified to the image processing unit 202, the paper for the following page cannot be fed while the previous page is being printed. If more time than the paper feed interval set in step S210 has lapsed since the previous page was fed, the paper feed interval is not controlled. In step S212, the image processing unit 202 detects the applied-toner amount for the page printed in step S211 using the video count unit 205.

The applied-toner amount is detected for each page by the following procedure. First, a video count unit 125 measures video signals. Next, from the measured video signals, the image processing unit 202 analyzes each pixel that forms an image to determine whether each pixel is to be printed (exposed). Then, the image processing unit 202 divides the number of pixels that are to be printed (exposed) by the number of all pixels to detect the applied-toner amount in percent (ratio).

For example, if the video count signals including 432,000 pixels for one page are measured and it is determined that 216,000 pixels are to be printed (exposed), 50 percent of the applied-toner amount is detected. In step S213, the processing unit 202 substitutes the applied-toner amount detected in step S212 into the variable "T".

In step S214, the image processing unit 202 records the applied-toner amount detected in step S212 in the applied-toner amount table in the job information storage unit 206. When the job management table does not exist in the job-information storage unit 206 in step S214, the image processing unit 202 creates the job management table and records the job information in the job management table. The job management table does not exist in the job-information storage unit 206 in a case where, for example, the received job has been a first job input after the printer 200 is started up or after the printer 200 is initialized.

Next, in step S215, the image processing unit 202 determines whether there is any page left for printing. This determination is made by checking whether there is image data for the following page in the image data storage unit 207. When it is determined that there is a page left for printing in step S215, the processing returns to step S209, and the image processing unit 202 prints the following page with the printing unit 203. When it is determined that there is no page left for printing in step S215, the processing is ended.

Figure 9:
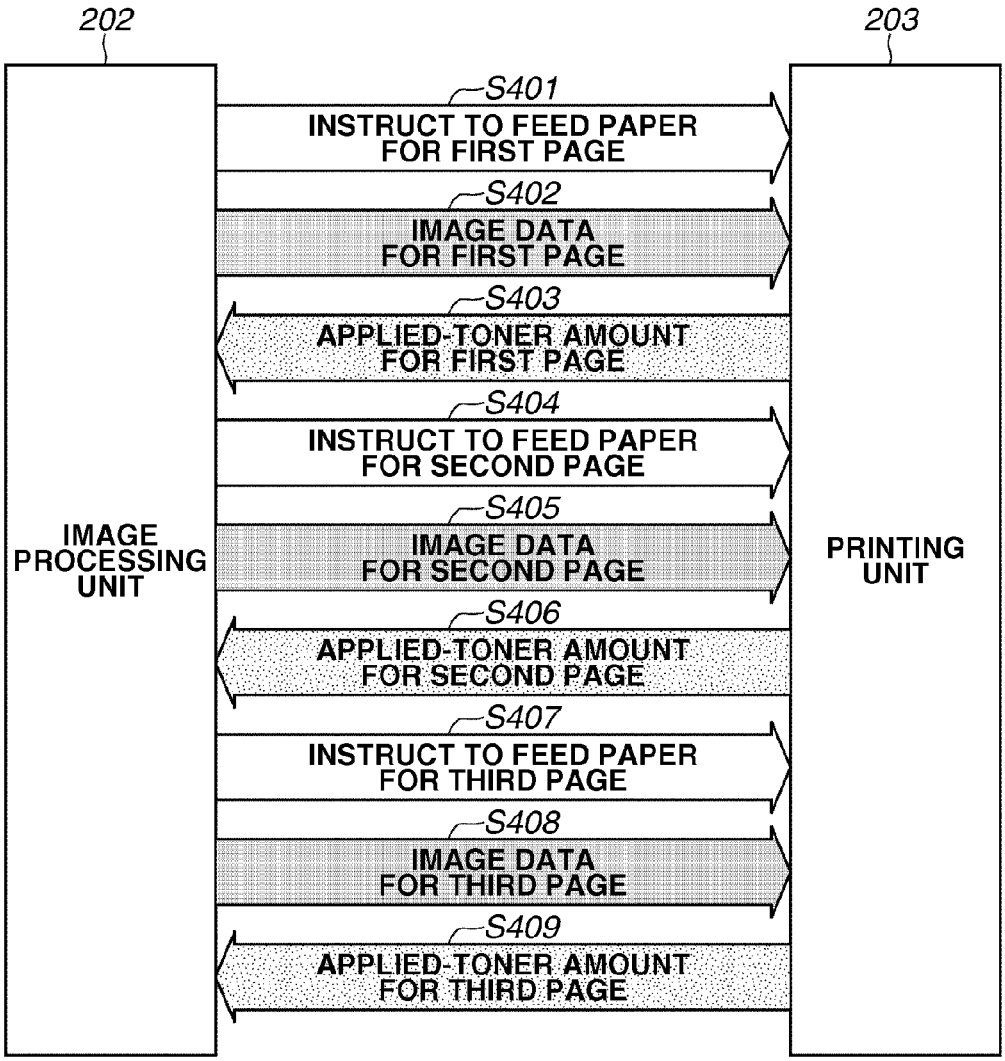
FIG. 9 is a diagram illustrating in a time series fashion the communication of signals between the image processing unit and the printing unit when loop processing from steps S209 to S215 is performed as illustrated in FIG. 7.

FIG. 9 is a diagram illustrating in a time series fashion the communication of signals between the image processing unit 202 and the printing unit 203 when loop processing from steps S209 to S215 is performed. Steps S401 to S403 illustrate for the first page, steps S404 to S406 illustrate for the second page, and steps S407 to S409 illustrate for the third page the communication of the signals when the loop processing from S209 to S215 is performed.

Figure 10:
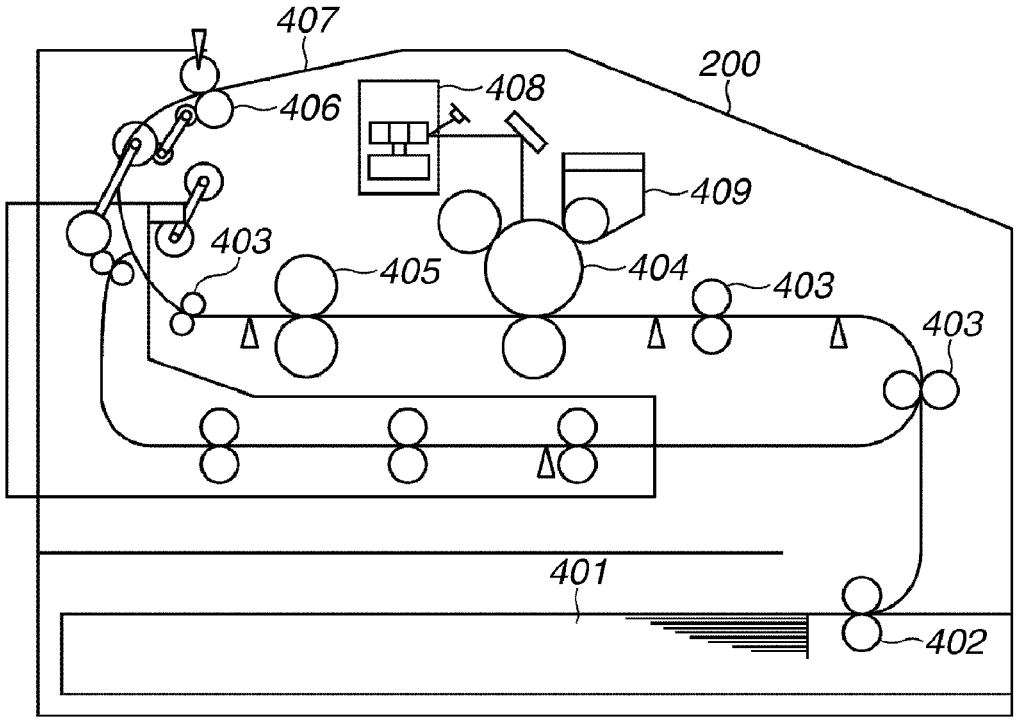
FIG. 10 is a vertical-cross sectional view of the printer according to the exemplary embodiment of the present invention.

As described above, in the job for the first copy, since the paper feed time interval (or conveyance speed of the paper) is controlled only after the applied-toner amount is obtained, the time for printing takes longer. FIG. 10 illustrates a vertical cross section of the printer 200, and specifically corresponds to a structure of the printing unit 203.

A paper feed tray 401 holds the paper to be printed serving as a paper feeding unit. A paper feed roller 402 feeds the paper from the paper feed tray 401. A conveyance roller 403 conveys the paper within the apparatus. A photosensitive drum 404 transfers an image (toner) onto a paper sheet. A fixing roller 405 fixes the image (toner) transferred onto the paper. A paper discharge roller 406 discharges the paper to a discharged-paper tray 407. The discharged-paper tray 407 holds the printed paper serving as a discharged-paper unit.

An exposure unit 408 exposes and forms an electrostatic latent image on the photosensitive drum 404 using the laser. A development unit 409 (toner cartridge) develops the electrostatic latent image created by the exposure unit 408 using the toner. The exposure unit 408 exposes the photosensitive drum 404 based on the video count value, and the development unit 409 develops the toner on an exposed part of the photosensitive drum 404.

In other words, the video count value and the amount of toner transferred onto the paper are in a proportional relation to each other. In steps S205 and S211, the paper in the paper feed tray 401 is fed by an operation of the paper feed roller 402, is subjected to transfer by the photosensitive drum 404, subjected to the fixing by the fixing roller 405, and discharged by an operation of the paper discharge roller 406 to the discharged-paper tray 407.

The rollers 402 to 406 are operated in association with each other and are constructed such that the paper is not jammed while in a printing operation. According to the present exemplary embodiment, the paper feed roller 402 controls the paper feed time interval (or paper feeding speed) of the papers so that the paper discharge time interval (or paper discharge speed) for discharging the printed paper to the discharged-paper tray 407 is controlled.

Not only the paper feed roller 402 but also any one of the rollers 403 to 406 may be controlled to control the paper discharge time interval (or paper discharge speed) for discharging the printed paper to the discharged-paper tray 407.

Figure 11A:
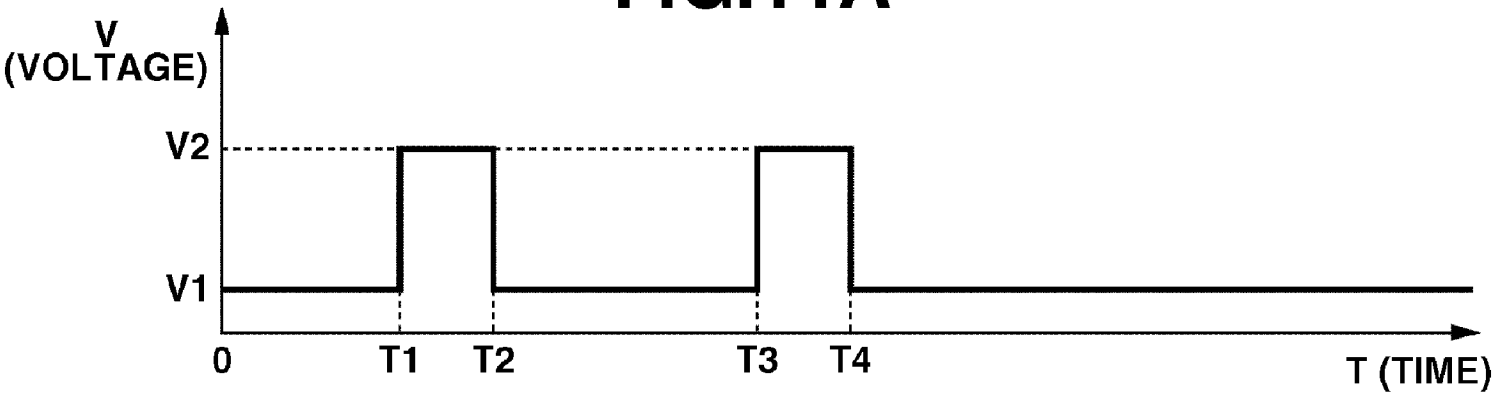
FIGS. 11A and 11B are time charts illustrating an operation for feeding paper by a feeding-paper roller according to the exemplary embodiment of the present invention.
Figure 11B:
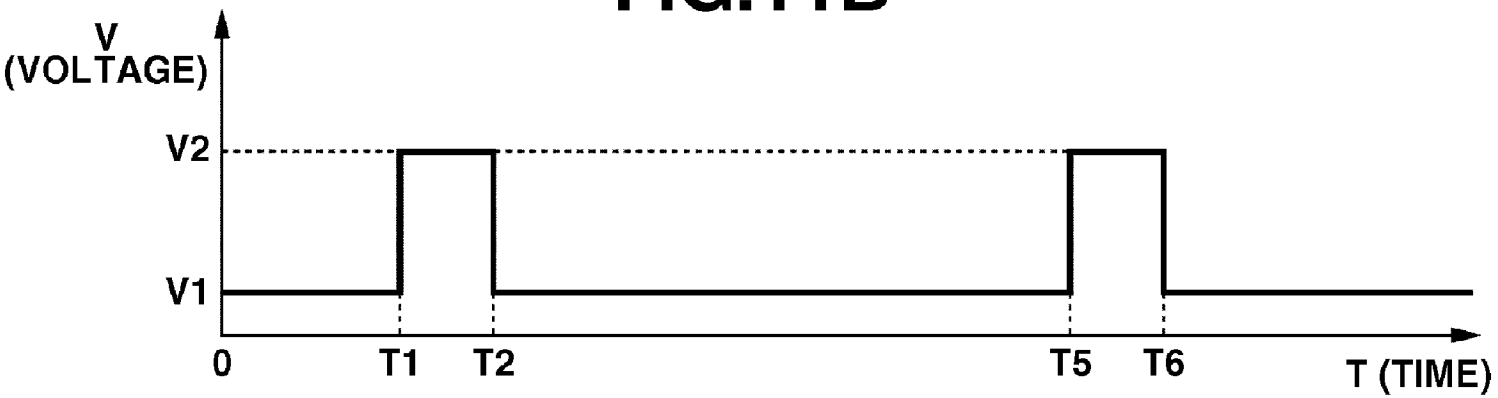

FIGS. 11A and 11B are time charts illustrating an operation for feeding paper by a paper feed roller 402, specifically correspond to the operations for feeding the paper when performing printing in steps S206 and S211. FIG. 11A illustrates a case where the paper feed time interval is small. FIG. 11B illustrates a case where the paper feed time interval is large.

In each time chart, the lateral axis corresponds to the time "T" since the printing is started, the vertical axis corresponds to the voltage "V" for driving the paper feed roller 402. V1 is a voltage at the time of waiting, and V2 is a voltage at the time of feeding the paper. When the paper is fed, the rectangular pulse voltage V2 is applied to the paper feed roller 402. T1 is time for stating to feed the first paper, T2 is time for ending to feed the first paper, T3(T5) is time for starting to feed the second paper, and T4(T6) is time for ending to feed the paper.

According to the exemplary embodiment, the paper feed time interval between the papers refers to the time T1 to T3(T5) or the time T2 to T4(T6). When FIG. 11A and FIG. 11B are compared, it can be seen that by controlling the voltage applied to the paper feed roller 402, the paper feed time interval between the papers can be decreased or increased.

According to the present exemplary embodiment, the paper discharge time interval for the following printing job is controlled using the controlling information about the job that can be regarded as substantially the same from among the already performed jobs, so that the printed papers can be prevented from adhering to each other.

The present invention can be also realized when the above-described system or apparatus reads out and performs a program (software) that realizes the function of the above-described exemplary embodiment from a memory medium.

In this case, the program itself read out from the memory medium realizes a new function of the present invention, and the program and the storage medium storing the program are included in the present invention.

As the storage medium for supplying the program code, for example, a floppy disk, hard disk, ROM, optical disk, magnet-optical disk, compact disk read only memory (CD-ROM), digital versatile disk ROM (DVD-ROM), DVD random access memory (DVD RAM), magnetic tape, memory card, and the like can be used.

Further, based on an instruction of the program, the present invention also includes a case where an operation system (OS) running on the computer performs a part or all of the actual processing, which realizes the functions of the above-described exemplary embodiment.

Furthermore, after the program can be written in the memory provided in a function extension unit connected to the computer. In this case, the present invention also includes a case where the CPU provided in the function extension unit can perform a apart or all of the actual processing, which realizes the above-described functions of the exemplary embodiment.

While the present invention has been described with reference to exemplary embodiments, it is to be understood that the invention is not limited to the disclosed exemplary embodiments. The scope of the following claims is to be accorded the broadest interpretation so as to encompass all equivalent structures, and functions.

This application claims priority from Japanese Patent Application No. 2007-328729 filed Dec. 20, 2007, which is hereby incorporated by reference herein in its entirety.

What is claimed is:

1. A printing apparatus comprising:

a receiving unit configured to receive a printing job including a plurality of pages of image data;

a printing unit configured to perform printing processing on a plurality of substrates based on the printing job received by the receiving unit;

a substrate discharge unit configured to discharge the plurality of substrates which has been subjected to the printing processing by the printing unit;

a storage unit configured to store job information for specifying the printing job and substrate-discharge time-interval control information for controlling a substrate discharge time-interval at which the substrate discharge unit discharges the plurality of substrates to the substrate discharge section;

a determination unit configured to, when the printing processing is performed based on the received printing job, determine whether there exists an already performed printing job that is substantially the same as the received printing job based on the job information stored in the storage unit; and a control unit configured to, when the determination units determines that the already performed printing job exists, control the substrate discharge time-interval based on the substrate-discharge time-interval control information corresponding to the performed printing job.

2. The printing apparatus according to claim 1, further comprising a generation unit configured to generate the substrate-discharge time-interval control information corresponding to the printing job by analyzing image data included in the printing job while the printing processing is being performed based on the received printing job, wherein, when the determination unit determines that there exists no performed printing job that is substantially the same as the received printing job, the control unit controls the substrate discharge time-interval based on the substrate-discharge time-interval control information generated by the generation unit.

3. The printing apparatus according to claim 2, wherein the generation unit generates the substrate-discharge time-interval control information such that the substrate discharge time-interval is increased along with increase of a ratio of the image data that is to be printed, in the image data included in the received printing job for each page.

4. The printing apparatus according to claim 1, wherein, when the determination unit determines that a plurality of the performed printing jobs exist, the control unit controls the substrate discharge time-interval based on the substrate-discharge-interval control information about an earliest performed printing job of the plurality of the printing jobs.

5. The printing apparatus according to claim 1, wherein the determination unit compares one or more of a job name, job owner name, host name, condition for discharging substrate, the number of pages, and data hash value included in the job information to determine whether there exists the already performed printing job that is substantially the same as the received printing job.

6. The printing apparatus according to claim 1, wherein the substrate-discharge time-interval control information includes information for controlling a substrate discharge time-interval for each substrate between a plurality of substrates which are subjected to the printing processing based on the received printing job; and wherein the control unit controls the substrate discharge time-interval for each substrate between the plurality of substrates which are subjected to the printing processing based on the received printing job.

7. The printing apparatus according to claim 1, further comprising:

a substrate feed unit configured to feed substrate which is subjected to the printing processing by the printing unit, wherein the control unit controls the substrate feed time-interval at which the substrates are fed by the substrate feed unit, based on the substrate-discharge time-interval control information corresponding to the already performed printing job, so that the control unit can control the substrate discharge time-interval.

8. The printing apparatus according to claim 1, further comprising a conveyance unit configured to convey the substrate which is subjected to the printing processing by the printing unit, wherein the control unit controls a conveyance speed at which the substrate is conveyed by the conveyance unit, based on the substrate-discharge time-interval control information corresponding to the already performed printing job, so that the control unit can control the substrate discharge time-interval.

9. A method for printing comprising:

receiving a printing job including a plurality of pages of image data;

performing printing processing on a plurality of substrates based on the received printing job;

discharging the plurality of substrates on which the printing processing has been performed;

storing job information for specifying the printing job and substrate-discharge time-interval control information for controlling a substrate discharge time-interval at which the plurality of substrates are discharged to a substrate discharge unit;

determining whether, when the printing processing is performed based on the received printing processing, there exists an already performed printing job that is substantially the same as the received printing job based on the stored job information; and controlling, when it is determined that the already performed printing job exists, the substrate discharge time-interval based on the substrate-discharge time-interval control information corresponding to the performed printing job.

* * * * *